US006319865B1

(12) United States Patent
Mikami

(10) Patent No.: US 6,319,865 B1
(45) Date of Patent: Nov. 20, 2001

(54) MELT-BLOWN NON-WOVEN FABRIC, AND NOZZLE PIECE FOR PRODUCING THE SAME

(75) Inventor: Takashi Mikami, Tokyo (JP)

(73) Assignee: Tonen Tapyrus Co., Ltd., Tokyo (JP)

( * ) Notice: Subject to any disclaimer, the term of this patent is extended or adjusted under 35 U.S.C. 154(b) by 0 days.

(21) Appl. No.: 09/358,764

(22) Filed: Sep. 2, 1999

(51) Int. Cl.[7] ..... D04H 1/56

(52) U.S. Cl. ..... 442/400; 442/340; 442/341; 442/346; 442/351; 442/402; 442/408

(58) Field of Search ..... 442/400, 340, 442/341, 346, 351, 402, 408

(56) References Cited

U.S. PATENT DOCUMENTS 4,692,371 * 9/1987 Morman et al. ..... 428/224
4,820,577 * 4/1989 Morman et al. ..... 428/228
5,407,739 * 4/1995 McCullough et al. ..... 428/287
5,582,907 * 12/1996 Pall ..... 428/287
5,695,377 * 12/1997 Triebes et al. ..... 442/359
5,877,098 * 3/1999 Tanaka et al. ..... 442/341
6,136,409 * 10/2000 Kondo et al. ..... 428/114

* cited by examiner

*Primary Examiner*—Elizabeth M. Cole
*Assistant Examiner*—Arti R. Singh
(74) *Attorney, Agent, or Firm*—Armstrong, Westerman, Hattori, McLeland & Naughton, LLP

(57) ABSTRACT

The nozzle piece of the present invention is provided with circular cross sectional nozzles having different sizes disposed in a row in front of the die, with n-numbered smaller nozzles B (hole diameter: Db) between adjacent larger nozzles A (hole diameter: Da). It gives melt-blown non-woven fabric of monolithic structure in one step, composed of fine fibers having a diameter in a range from 1 to 10 $\mu$m diameter Variance ratio F of 2.0 or more and wide fiber diameter distribution.

1 Claim, 1 Drawing Sheet

MELT-BLOWN NON-WOVEN FABRIC, AND NOZZLE PIECE FOR PRODUCING THE SAME

BACKGROUND OF THE INVENTION

1. Field of the Invention

This invention relates to a melt-blown non-woven fabric having a wide fiber diameter distribution, in which fine fibers with different diameters are adequately dispersed, and also to a nozzle piece applied for producing the same.

2. Prior Art

Production of non-woven fabrics by melt blowing has been known since a long time. The principle was disclosed by, e.g., U.S. Naval Research Laboratory's Report No. 5256, Feb. 11, 1959. It was also described in detail by EXXON Chemical, which commercialized the production for the first time in the world, in Japanese Laid-open Patent Application No. 50-46972 and "Melt Blowing-One-step Web Process for New Non-woven Products (Tappi Journal, vol. 56, No.4, April, 1973).

In this process, a number of nozzles of a given diameter is disposed at a given "hole-to-hole" pitch in front of the die, and molten polymer discharged therefrom is spun in a flow of a hot air jet, wherein a non-woven fabric is produced with fine fibers having a relatively uniform diameter.

The diameter of the fibers is optionally controlled by process conditions of melt blowing, the major ones including polymer temperature, and rates of discharged polymer and air. The non-woven fabric thus prepared is characterized by a relatively uniform diameter of the fibers which constitute the fabric.

When such a non-woven fabric is applied to, e.g., a liquid filter, filtration efficiency is largely determined by the diameter of the fibers which constitute the fabric.

However, a filter composed of very fine fibers tends to be clogged in a short time with the particles and such clogging decreases service life, although it can capture very fine particles.

So far melt-blown non-woven fabrics composed of fiber of different diameters have been developed, in order to solve the above problems. For instance, they are generally produced by the multi-die process which uses two or more dies equipped with nozzles of different sizes respectively, or by lamination in which two or more non-woven fabrics each composed of fibers having different diameters are placed one on another, in order to obtain the required filtration efficiency of the filter and extend its service life. The lamination to each other is performed by using an adhesive or by heat with thermal calender rolls.

These methods, however, tend to increase production cost, and also require delicate processing control. Such additional process may cause quality-related problems, e.g., deterioration of the fabrics by heat or delamination during the service period.

SUMMARY OF THE INVENTION

The present invention provides, in solving the above problems, a melt-blown non-woven fabric formed in a single step into a monolithic structure with a wide fiber diameter distribution, and also provides a nozzle piece applied for producing the same.

The inventor of the present invention has found that use of a nozzle piece having a different hole size in a specific range can provide a wide diameter distribution of the fibers and form a non-woven fabric of monolithic structure in which fibers having a diameter in a range from 1 to 10 $\mu$m are adequately dispersed, i.e., a non-woven fabric having a wide fiber diameter distribution, to be applied for filter media which will achieve high filtration efficiency together with long service life.

The first invention relates to a single, melt-blown non-woven fabric composed of very fine fibers of 1 to 10 $\mu$m in diameter with a Variance ratio F (defined by the following formula) greater than 2.0 by using a nozzle piece having nozzles A with circular cross section (hole diameter: Da) and nozzles B also with circular cross section (hole diameter: Db, which is smaller than Da) aligned in front of the die, wherein the n-numbered nozzles B are disposed between the two adjacent nozzles A: Variance ratio: $V/V_0$($V_0$ is a variance of fiber diameter which a non-woven fabric would have produced by a nozzle piece with nozzles of the same hole size, and V is that for the non-woven fabric of the present invention).

The second invention relates to a nozzle piece applied for a melt-blown non-woven process having nozzles A with circular cross section (hole diameter: Da) and nozzles B also with circular cross section (hole diameter. Db, which is smaller than Da) aligned in front of the die, wherein 2 to 4 nozzles B are disposed between two adjacent nozzles A, and Da/Db ratio lies in a range between 1.3 to 2.0.

DETAILED DESCRIPTION OF THE INVENTION

Figure 1:
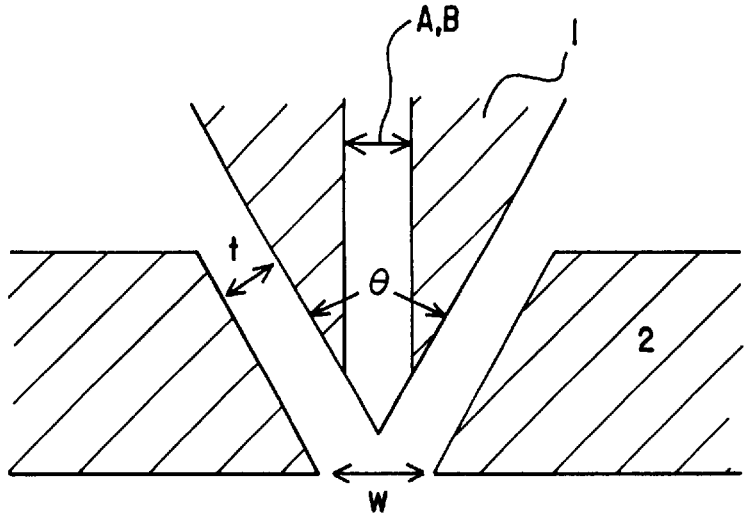
FIG. 1 is a cross-sectional view of a melt blow die.
Figure 2:
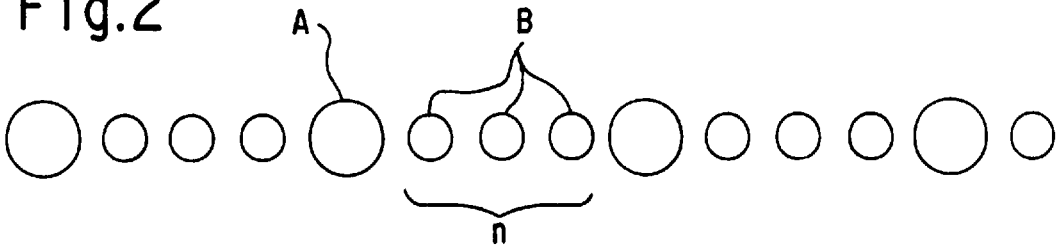
FIG. 2 is nozzle hole arrangement in a nozzle piece for a melt blow die.

1. Nozzle Piece melt-blown non-woven fabric is normally produced by a die having a section shown in FIG. 1, wherein molten polymer is discharged from a number of nozzle holes aligned at a nozzle piece 1 attached in front of the die, and spun in a flow of a hot air jet, discharged from an air slit. The non-woven fabric produced by this method is composed of very fine fibers, characterized by a narrow diameter distribution.

The nozzle piece of the present invention produces, in one step, a non-woven fabric of wide fiber diameter distribution while they are spun by melt blowing, wherein fibers of 1 to 10 $\mu$m in diameter are adequately dispersed to form a non-woven fabric. More concretely, a nozzle piece (FIG. 1) is prepared with a number of nozzles A with circular cross section (hole diameter: Da) and nozzles B also with circular cross section (hole diameter: Db, which is smaller than Da) aligned in front of the die, wherein the n-numbered nozzles B are disposed between the two adjacent nozzles A. The nozzle pitch (hole center distance) for the nozzles A—A and nozzles B—B are set constant. The number of the nozzles B between the two adjacent nozzles A is taken between 2 to 4 (n=2 to 4). When n is taken below 2 or above 4, the melt-blown non-woven fabric will have a narrow fiber diameter distribution, and also the fibers may not be spun smoothly.

The ratio R of the nozzle A to nozzle B in hole diameter (i.e., R =Da/Db) ranges from 1.3 to 2.0. When R is taken below 1.3, the melt-blown non-woven fabric will have a narrow fiber diameter distribution. R above 2.0 is also undesirable, because an unbalanced discharge of molten polymer occurs, then many shots originate.

The nozzle A has a bole diameter (Da) of 0.30 to 1.0 mm, whereas the nozzle B has a hole diameter (Db) ranging from 0.20 to 0.80 mm. Db below 0.20 mm is undesirable, because of difficulty in machining of such a nozzle. On the other hand, the nozzle A having a hole diameter Da above 1.0 mm will be difficult to give sufficiently fine fibers, causing the fiber diameter to exceed 10 μm, which is beyond the scope of the present invention.

2. Melt-blown Non-woven Fabric

The melt-blown non-woven fabric of the present invention is produced by the above nozzle piece for melt blowing. It is a mono-layer fabric having a wide fiber diameter distribution and composed of the fibers having a diameter of 1 to 10 μm and its variance ratio more than 2.

Figure 3:
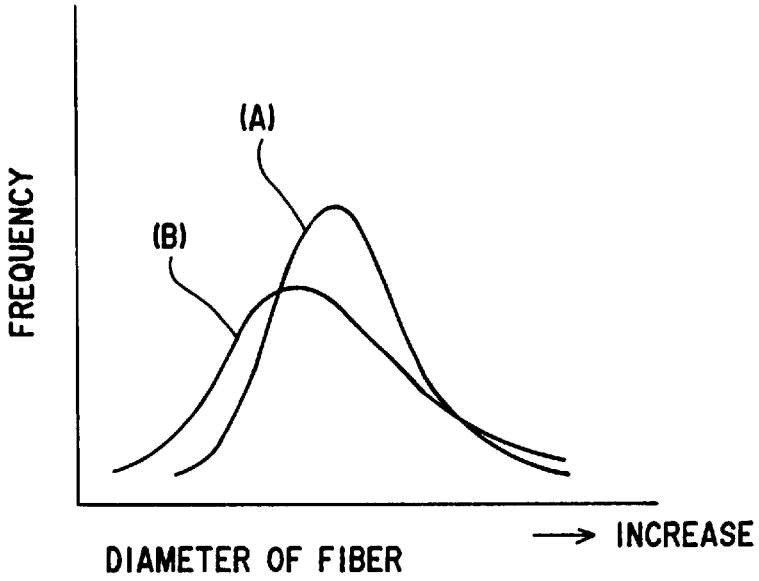
FIG. 3 is fiber diameter distributions of melt-blown non-woven fabrics

The conventional melt-blown non-woven fabric produced by nozzles of the same hole size has generally a narrow fiber diameter distribution, represented by a narrow distribution shown in FIG. 3(A). On the other hand, the melt-blown non-woven fabric of the present invention has a wider fiber diameter distribution (FIG. 3(B)) than the conventional one having a narrow fiber diameter distribution, because it is produced using a nozzle piece equipped with nozzles of different hole sizes, a specific number of smaller nozzles being disposed between two adjacent larger nozzles.

When the melt-blown non-woven fabric of the present invention is applied to a liquid filter, the non-woven fabric can capture fine particles with longer service time without clogging. The filter can retain its original characteristics, because it uses no adhesive or the like, and is free of the problems, e.g., deterioration resulting from delamination of the fabric layers during the service period.

Thermoplastic resins used for the melt-blown non-woven fabric in the present invention include polyolefin, polyamide, polyacrylonitrile, polyester, styrene-polyolefin copolymer, fluorine-containing resin, polyarylene sulfide. Of these, polypropylene as one type of polyolefin is preferable.

The above resin may be incorporated, as required, with a colorant, additive, modifier, inorganic filler or the like.

3. Production of the Non-woven Fabric

The melt-blown non-woven fabric in the present invention, characterized by its wide fiber diameter distribution, is produced by the die equipped with the nozzle piece of the present invention, wherein a molten resin is introduced by a single or twin screw extruder into the die, and discharged from the nozzles of different size, drawn by a high-speed flow of air, and collected by a screen on a conveyor moving at 1 to 50 m/min, to form a melt-blown non-woven fabric. Conveyor speed and rate of the molten resin discharged from the nozzles are adjusted to control basis weight and thickness of the fabric.

4. Effects of the Present Invention

The melt-blown non-woven fabric produced using the nozzle piece of the present invention is composed of fibers produced in one step by melt blowing to have a varying diameter in a range from 1 to 10 μm and adequately dispersed to form a mono layer fabric. The nozzle piece of the present invention gives a non-woven fabric of wide fiber diameter distribution and efficiently produces a filter media exhibiting filtration characteristics comparable to those of the conventional non-woven fabric material, in which two or more fabrics with different fiber diameter, produced separately, are laminated with each other.

EXAMPLE

The present invention is described by EXAMPLES and COMPARATIVE EXAMPLES, where the following analytical procedures were used.

(1) Average fiber diameter: The non-woven fabric was observed by a scanning electron microscope, to produce the image having a magnification of 1,000, from which 30 fibers were sampled at random to measure their diameters.

(2) Fiber diameter Variance ratio F: An unbiased variance $V_0$ was determined as a measure of scattering of fiber diameter of the non-woven fabric prepared by COMPARATIVE EXAMPLE 1, and unbiased variance V for the non-woven fabric prepared by each of EXAMPLES was determined. The ratio $V/V_0$ was examined to distinguish the significance (F=2.0: cited from the F-distribution for the confidence limits at degrees of freedom of $\phi_0$ and $\phi_1$=30 and 97.5%).

(3) Fiber diameter distribution: A non-woven fabric was tested to have a sufficiently wide fiber diameter distribution, when its fiber diameter Variance ratio F, defined as $F=V/V_0$, exceeded 2.0.

(4) Shot number: The as-received fabric, cut into a 10 cm square sheet at random, was visually observed, and it was examined to have an unacceptably large number of shots, when 3 or more visually detectable shots were found.

(5) Filtration efficiency: Filtration performance of the non-woven fabric was measured by the following liquid filtration assessment apparatus, where it was assessed by a total quantity (liter) of a liquid suspending fine particles was passed through the filter until its pressure loss reached up to 1 kg/cm$^2$. Assessment apparatus: ADVANTEC's TSU-47B Fine particles: JIS type 11 Liquid rate: 500 cc/min (constant)

Comparative Example 1

Polypropylene resin having a melt flow rate (MFR) of 40 was molten under heating by the following extruder, and introduced into a die, where it was discharged from a number of nozzles into a flow of a hot air jet to spin the fiber. These fibers were collected on a conveyor and formed into a non-woven fabric, 5.5 μm in average fiber diameter and 60 g/cm$^2$ as weight per unit area, by allowing themselves to adhere to each other. Formation of shots while the non-woven fabric was formed was also observed.

The filtration performance test was conducted for the non-woven fabric used for a liquid filter. The results are given in Table 1.

Non-woven Fabric Production Apparatus (1) Extruder: Single screw extruder (Ikegai Tekko), with a screw size 50 mm in diameter (2) Nozzle piece: Referring to a die structure shown in FIG. 1, the nozzle piece was equipped with nozzles which were disposed in a row at pitches of 30 holes/inch over a total width of 250 mm, having the following dimensions, air slit width t: 0.20 mm, nozzle edge angle θ; 60°, air lip opening: 0.4 mm, and hole diameter (Da): 0.4 mm.

(3) Conveyor: The conveyor had a screen moving at 1 to 50 m/min to collect the fibers and form them into a non-woven fabric.

Process conditions of the non-woven fabric production apparatus

| | |
|---|---|
| Extruder barrel temperature | 320° C. |
| Screw rotational speed | 40 rpm |
| Discharge rate | 5 kg/h |
| Die temperature | 290° C. |
| Die-screen distance | 200 mm |
| Air temperature | 280° C. |
| Air rate | 5 Nm$^3$/min |

Example 1

The same procedure as used for COMPARATIVE EXAMPLE 1 was repeated, except that the nozzle piece was replaced by the one equipped with nozzles A (hole diameter Da: 0.6 mm) and nozzles B (hole diameter Db; 0.4 mm), 2 of which were disposed between the two adjacent nozzles A, to form a non-woven fabric having an average fiber diameter of 5.6 μm.

Its fiber diameter and fiber diameter distribution were determined by the same procedures as used for COMPARATIVE EXAMPLE 1. Its fiber diameter distribution was compared with that of the fabric prepared by COMPARATIVE EXAMPLE 1, to judge the difference. The number of shots and also filtration efficiency of the non-woven fabric were measured In the same procedures as used for COMPARATIVE EXAMPLE 1. The results are given in Table 1.

Examples 2 to 3, and Comparative Examples 2 to 5

The procedure as used for COMPARATIVE EXAMPLE 1 was applied for making each of these EXAMPLES and COMPARATIVE EXAMPLES, as shown in Table 1, the nozzle piece was replaced by the one equipped with nozzles A (hole diameter: Da) and nozzles B (hole diameter: Db) of varying hole diameter ratio R (Da/Db) and number (n) of the nozzles B between the adjacent nozzles A, to form a non-woven fabric.

[Table 1]

TABLE 1

| | COMPARATIVE EXAMPLE | | | | | EXAMPLE | | |
|---|---|---|---|---|---|---|---|---|
| | 1 | 2 | 3 | 4 | 5 | 1 | 2 | 3 |
| Nozzle piece | | | | | | | | |
| Nozzle A - Pore diameter Da (mm) | 0.4 | 0.5 | 0.6 | 0.6 | 1.1 | 0.6 | 0.6 | 0.8 |
| Nozzle B - Pore diameter Db (mm) | — | 0.4 | 0.4 | 0.4 | 0.4 | 0.4 | 0.4 | 0.4 |
| Pore diameter ratio R (Da/Db) | — | 1.2 | 1.5 | 1.5 | 2.75 | 1.5 | 1.5 | 2 |
| Number of nozzles B (n) | 0 | 4 | 5 | 1 | 2 | 2 | 4 | 2 |
| Non-woven fabric | | | | | | | | |
| Average fiber diameter | 5.5 | 5.7 | 5.5 | 5.3 | 11.5 | 5.6 | 5.4 | 7.0 |
| Fiber diameter dispersion F | 1 | 1.4 | 1.6 | 1.5 | 4 | 4.4 | 3.5 | 3.1 |
| Fiber diameter distribution* | Reference | Narrow | Narrow | Narrow | Wide | Wide | Wide | Wide |
| Shots | Not many | Not many | Not many | Not many | Many | Not many | Not many | Not many |
| Filtration effect | | | | | | | | |
| Initial pressure (kg/cm$^2$) | 0.7 | 0.7 | 0.7 | 0.7 | No fine particles captured | 0.6 | 0.6 | 0.5 |
| Service Life (liter) | 1.0 | 1.1 | 1.2 | 1.1 | | 1.5 | 1.5 | 1.6 |

As shown in Table 1, the nozzle piece of the present invention which is equipped with 2 or 4 smaller nozzles B set between adjacent larger nozzles A(EXAMPLES 1 to 3) gives a non-woven fabric of wider fiber diameter distribution and longer service life than the one which is equipped with nozzles of the same hole diameter (prepared by COMPARATIVE EXAMPLE 1). In case when nozzle diameter ratio R is set at 1.2, which is below the range of the present invention, the non-woven fabric has a narrower fiber diameter distribution and hence shorter service life, although 4 of smaller nozzles B are disposed between two larger nozzles A (COMPARATIVE EXAMPLE 2). In case when 5 or more smaller nozzles are disposed between two adjacent larger nozzles A, the non-woven fabric also has a narrower fiber diameter distribution and shorter service life (COMPARATIVE EXAMPLE 3). The similar trend is observed, when only one smaller nozzle B is disposed between adjacent larger nozzles A (COMPARATIVE EXAMPLE 4). When the nozzle diameter ratio R is beyond the range of the present invention, such non-woven fabric does not capture fine particles, because of a non-uniform polymer flow discharged from the adjacent nozzles of different hole sizes, which causes unbalanced melt spinning conditions and originates an excessive number of shots (COMPARATIVE EXAMPLE 5).

What is claimed is:

1. Melt-blown non-woven fabric composed of fibers of 1 to 10 $\mu$m in diameter, having a fiber diameter distribution with a fiber diameter Variance ratio (F), defined by the following formula, more than 2.0, obtained by using a nozzle piece equipped with a plurality of nozzles (A) having circular cross section with a hole diameter (Da) and nozzles (B) also having circular cross section with a hole diameter (Db), which is smaller than (Da), disposed in a row in front of the die, wherein a ratio Da/Db is from 1.3 to 2.0, and wherein 2 to 4 of the nozzles (B) are disposed between the adjacent nozzles (A);

Fiber diameter Variance ratio: $V/V_0$ wherein ($V_0$) is an unbiased variance of fiber diameter which a non-woven fabric would have when produced by a nozzle piece with nozzles of the same hole diameter, and (V is an unbiased variance of fiber diameter for the non-woven fabric produced by said nozzle piece equipped with nozzles (A) and (B).

* * * * *